US012807887B2

(12) United States Patent
Redman et al.

(10) Patent No.: US 12,807,887 B2
(45) Date of Patent: Nov. 24, 2026

(54) FUEL OIL RECLAMATION

(71) Applicant: SULNOX GROUP PLC, London (GB)

(72) Inventors: James Redman, Kloof (CA); Dan Clarke, Leeds (GB)

(73) Assignee: SULNOX GROUP PLC, London (GB)

( * ) Notice: Subject to any disclaimer, the term of this patent is extended or adjusted under 35 U.S.C. 154(b) by 99 days.

(21) Appl. No.: 18/718,937

(22) PCT Filed: Dec. 13, 2022

(86) PCT No.: PCT/EP2022/085716
§ 371 (c)(1),
(2) Date: Jun. 12, 2024

(87) PCT Pub. No.: WO2023/110938
PCT Pub. Date: Jun. 22, 2023

(65) Prior Publication Data

US 2025/0043200 A1 Feb. 6, 2025

(30) Foreign Application Priority Data

Dec. 13, 2021 (GB) ..... 2118030

(51) Int. Cl.
*C10G 33/04* (2006.01)

(52) U.S. Cl.
CPC ..... *C10G 33/04* (2013.01); *C10G 2300/208* (2013.01); *C10G 2400/06* (2013.01)

(58) Field of Classification Search
CPC ..... C10G 33/04; C10G 2300/208; C10G 2400/06; C10G 33/06; C02F 2001/007; C02F 2101/32; C02F 2103/008; C02F 1/36; C02F 1/682; C02F 2101/325; C10L 2250/082; C10L 2250/084; C10L 2290/34; C10L 2290/54
See application file for complete search history.

(56) References Cited

U.S. PATENT DOCUMENTS 3,594,314 A 7/1971 Bilhartz et al.
4,738,795 A 4/1988 Farnan
(Continued)

FOREIGN PATENT DOCUMENTS

JP S 61-209294 A 9/1986
JP S 64-38104 A 2/1989
(Continued)

OTHER PUBLICATIONS

International Search Report issued in International Application No. PCT/EP2022/085716, dated Mar. 17, 2023.
(Continued)

*Primary Examiner* — Ellen M McAvoy
(74) *Attorney, Agent, or Firm* — Medler Ferro Woodhouse & Mills PLLC

(57) ABSTRACT

There is provided a demulsifier comprising at least one $C_8$ to $C_{18}$ fatty acid diethanolamide, at least one $C_{12}$ to $C_{24}$ fatty acid, at least one $C_6$ to $C_{18}$ alcohol ethoxylate for use in the recovery of a fuel oil from a fuel oil-in-water emulsion. There is additionally provided a process for the recovery of a fuel oil from a fuel oil-in-water emulsion using the demulsifier.

10 Claims, 4 Drawing Sheets

(56) References Cited

U.S. PATENT DOCUMENTS

Figure 1:
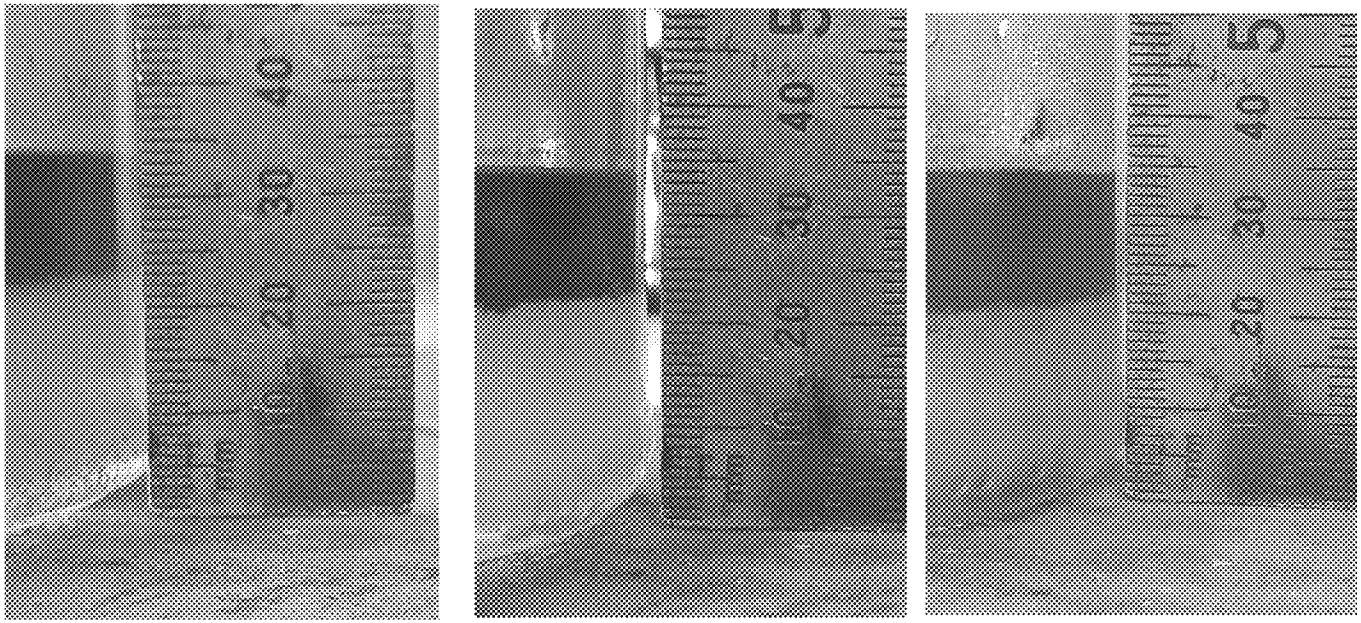

| | | | | |
|---|---|---|---|---|
| 5,882,506 | A * | 3/1999 | Ohsol | C10G 33/04 208/186 |
| 11,053,788 | B2 * | 7/2021 | Abdel-Fattah | B01D 17/04 |
| 12,054,407 | B1 * | 8/2024 | Waller | C02F 1/488 |
| 2015/0225655 | A1 * | 8/2015 | Adams | C10G 25/003 516/138 |
| 2017/0175509 | A1 * | 6/2017 | Abdel-Fattah | C02F 1/36 |

FOREIGN PATENT DOCUMENTS

| | | | |
|---|---|---|---|
| WO | 2018014174 | A1 | 1/2018 |
| WO | 2020120635 | A1 | 6/2020 |
| WO | 2020182624 | A1 | 9/2020 |

OTHER PUBLICATIONS

Machine Translation of Notice of Reasons for Refusal issued Jul. 28, 2026 in JP Appl. No. 2024-535255.

* cited by examiner (a)

(b)

(c)

FUEL OIL RECLAMATION

This invention relates to processes separating waste-emulsified oil, especially heavy fuel oil, from water.

This invention relates to a novel process for the improved separation of oil from an oil-in-water emulsion. The process can be used to separate fuel oil and water emulsions such as waste emulsified heavy fuel oil and water that has been obtained from ships. This waste emulsion can come from bilge water and cargo tank washing, and is commonly known as "ship slops".

It is known that when heated to 65° C., these ship slops will separate over a period of approximately 12-24 hours to yield approximately 20% water separated phase.

However, ships slops contain large amounts of water, such as up to 90%, with only 10% HFO. A yield of only 20% water from separation with temperature alone still leaves the majority of water emulsified with the oil. The more water that is left as an emulsion with the oil, the less the value of the reclaimed oil.

There are a number of conventional methods for improving the separation of water-in-oil emulsions such as chemical demulsification, gravity or centrifugal separation, membrane separation, filtration and electrostatic demulsification.

Chemical emulsifiers were used individually by Yau et al ("Evaluation of different demulsifiers for Marpol oil waste recovery" (2017) Journal of water processing engineering 17; 40-49) to increase that water removal rate from Marpol oil waste which is mixture of seawater and wasted oil. Hajivand & Yaziri ("Optimisation of demulsifier formulation for separation of water from crude oil emulsions" (2015) Brazilian Journal of Chemical engineering 32(1); 107-118) describe the use of a combination of water soluble and oil soluble emulsifiers to aid the separation of water in crude oil emulsions.

The current separation techniques which are commercially available require large scale equipment to treat the huge volumes of ship slops which are produced by ships and typically unloaded in ports. It would be advantageous to provide a process which gives a high level of separation of hydrocarbons from water without the need for large industrial equipment.

This invention relates to use of a demulsifier to improve this separation to recover up to 95% of the water. Recovery of a higher percentage of water from oil emulsions such as ships slops means the recovered oil has a lower water content and is therefore more valuable once reclaimed.

The process of the present invention can be used to recover oil from waste generated from a variety of processes, such as tank bottoms, marpol water, bilge water and ships slops.

For the purposes of the present invention, reference to oil includes fuel oil, and industrial oils such as chain oil, hydraulic oils and engine oils. Preferably, the term "oil" does not include crude oil or bitumen.

For the purposes of the present invention, reference to fuel oil is intended to cover diesel including petroleum diesel, low-sulphur diesel, biodiesel and combinations thereof, and heavy fuel oil (HFO).

For the purposes of the present invention, reference to petroleum diesel relates to diesel produced during the distillation of crude oil.

For the purposes of the present invention, reference to heavy fuel oil relates to oil produced during the distillation of crude oil and having a density greater than 900 kg/m$^3$ at 15° C.

For the purposes of the invention, reference to heavy fuel oil includes including Bunker C fuel oil, intermediate fuel oil, and low sulfur marine fuel oils For the purposes of the present invention, reference to low-sulphur diesel relates to diesel having less than 500 ppm, preferably less than 50 ppm, and most preferably less than 10 ppm sulphur. Low-sulphur diesel can be produced by removing the sulphur from petroleum diesel, by the formation of synthetic diesel or by the formation of bio-diesel.

For the purposes of the present invention, reference to biodiesel relates to fatty acid methyl ester obtained by transesterification of vegetable oils or animal fats with an alcohol, typically methanol or ethanol.

For the purposes of the present invention, reference to bio-components relates to biodiesel and naturally occurring oils, such as palm oil, rapeseed oil and coconut oil.

In a first aspect of the present invention, there is provided a process for recovering oil from an oil-in-water emulsion comprising:

(i) adding at least 0.01 wt % demulsifier to said oil-in-water emulsion (ii) dispersing the demulsifier in the oil using ultrasonication at 2-50 Ws/g;

(iii) allowing the oil and aqueous phases to separate; wherein the demulsifier comprises a. at least one $C_8$ to $C_{18}$ fatty acid diethanolamide;

b. at least one $C_{12}$ to $C_{24}$ fatty acid; and c. at least one $C_6$ to $C_{18}$ alcohol ethoxylate Preferably the oil-in-water emulsion is a waste oil-in-water emulsion. Such emulsions include tank bottoms, marpol water, bilge water and ships slops. These waste emulsions can be generated by washing out cargo tanks to remove residues of oily cargo, or from the emptying of ballast tanks.

Preferably the oil is a fuel oil.

Preferably the process is used to separate an emulsion of diesel, low sulphur diesel, biodiesel or heavy fuel oil in water.

The oil-in-water emulsion comprises at least 50% v/v water, preferably at least 60% v/v water, at least 70% v/v water, at least 80% v/v water, preferably up to 90% v/v water.

The process can be used to separate water from a waste water-in-oil emulsion, by firstly converting the water-in-oil emulsion to an oil-in-water emulsion. Thus, the process may further comprise the step of:

(i1) adding a volume of water to form an oil-in-water emulsion comprising at least 50% v/v water.

In practice, it is difficult to establish, quickly, the water content of a water-in-oil emulsion. Therefore, a simple method to produce an oil-in-water emulsion is to add a volume of water which is equal or greater than the amount of emulsion, thereby guaranteeing the water to be in excess. In a preferred embodiment, there is provided the step of:

(i1) adding a volume of water greater than or equal to the volume of the water-in-oil emulsion.

The addition of the water causes the nature of the emulsion to change to an oil-in-water emulsion. The water can be added prior to, or together with the demulsifier. Preferably, the water is added to the emulsion and mixed, forming the oil-in-water emulsion prior to the demulsifier being added.

Preferably, the demulsifier is used in an amount of from 0.01 to 5.0 wt % based on the amount of oil-in-water emulsion. More preferably, the demulsifier is used in an amount of from 0.05 to 4.0 wt % based on the amount of oil-in-water emulsion, from 0.1 to 3.5 wt % based on the amount of oil-in-water emulsion from 0.2 to 3.0 wt % based on the amount of oil-in-water emulsion, from 0.3 to 2.5 wt % based on the amount of oil-in-water emulsion or from 0.5 to 2.0 wt % based on the amount of oil-in-water emulsion. The demulsifier may be used in the amount of at least 0.01 wt %, at least 0.05 wt %, at least 0.075 wt %, at least 0.1 wt %, at least 0.2 wt %, at least 0.25 wt %, at least 0.5 wt %, at least 0.75 wt %, at least 1.0 wt %, at least 1.25 wt %, at least 1.5 wt %, at least 1.75 wt %, at least 2.0 wt %, at least 2.25 wt %, at least 2.5 wt %, at least 2.75 wt %, at least 3.0 wt %, at least 3.5 wt %, at least 4.0 wt %, or at least 5.0 wt %.

Demulsifiers suitable for use in the present invention may comprise a $C_{12}$-$C_{24}$ carboxylic acid. The $C_{12}$-$C_{24}$ carboxylic may be aliphatic or aromatic, saturated or unsaturated. Suitable carboxylic acids include fatty acids, which may be saturated or unsaturated.

Preferably, demulsifiers suitable for use in the present invention comprise at least one $C_{12}$ to $C_{24}$ fatty acid. Suitable fatty acids include oleic acid, lauric acid, myristic acid, palmitic acid, stearic acid, arachidic acid, behenic acid and linoleic acid. Preferably the demulsifier comprises oleic acid.

Preferably, the demulsifier comprises at least one $C_8$ to $C_{18}$ fatty acid diethanolamide.

It is preferred that the fatty acid diethanolamide is a formed from a mixture of fatty acids having from 8 to 18 carbon atoms. It is particularly preferred that the fatty acid diethanolamide is derived from a natural source. Suitable natural sources include coconut oil and palm oil. By way of example, coconut oil is a mixture of acids including caprylic, capric, lauric, myristic, palmitic, stearic, oleic and linoleic acids.

In a particularly preferred embodiment, the demulsifier comprises:

a. at least one $C_8$ to $C_{18}$ fatty acid diethanolamide;

b. at least one $C_{12}$ to $C_{24}$ fatty acid; and c. at least one $C_6$ to $C_{18}$ alcohol ethoxylate d. optionally at least one sorbitan ester.

Preferably, the demulsifier consists essentially of components (a), (b), (c) and optionally (d). If the oil-in-water emulsion comprises a biofuel, the demulsifier preferably comprises or consists essentially of components (a), (b), (c) and (d).

According to the present invention, consists essentially of means that a composition contains less than 2 wt %, preferably less than 1 wt % of other components.

Furthermore, using the above demulsifier composition provides lubricity benefits which improves the quality of the HFO compared to traditional low sulphur versions of HFO currently available where reductions in the amount of sulphur to meet environmental legislation (IMO 2020) have resulted in the reduction of the lubricity of HFO leading to mechanical problems.

One feature of components used in demulsifiers is the HLB. HLB values can either be calculated or determined experimentally. The standard methods of calculation include those of Griffin (Journal of the Society of Cosmetic Chemists 5 (1654): 259) or Davies (Gas/Liquid and Liquid/Liquid interface: Proceedings of the International Congress of the Surface Activity (1657). However, it is preferred that the HLB values are obtained experimentally. It is usual for suppliers of materials to provide HLB values for their products which are obtained experimentally. The skilled person is aware of suitable methods to determine the HLB value, such as using comparative testing by using a series of emulsions with a demulsifier and an oil of known HLB value. In general, a HLB in the range of 3.5 to 6 is commonly used for water in oil emulsions. A HLB in the range of 8 to 18 is used for oil-in-water emulsions.

Coconut oil diethanolamide typically has a HLB in the range of 13-14. Whilst it is not essential that the diethanolamide has an HLB in this range, it is preferred that the diethanolamide has an HLB in the range of 11-16 and preferably 13-14.

Fatty acid diethanolamides based on fatty acids with fewer than 8 carbon atoms or more than 18 carbon atoms can optionally be present in the mixture, although it is preferred that they are not.

It is preferred that the fatty acid diethanolamide is present in an amount of from 40 to 90 wt % of the demulsifier. It is more preferred that it is present in an amount of from 50 to 90 wt % and more preferably from 60 to 85 wt %.

The at least one $C_{12}$ to $C_{24}$ fatty acid is preferably saturated or monounsaturated, with monounsaturated fatty acids being further preferred. The fatty acid is preferably a $C_{14-20}$ monounsaturated fatty acid. A particularly suitable fatty acid is oleic acid.

Oleic acid has a HLB of approximately 1. A low HLB means that it is highly lipophilic and therefore a material of this lipophilicity is not typically used as a demulsifier. It is preferred that the fatty acid has a low HLB, preferably below 3.5 and more preferably below 2.

The fatty acids are preferably present in an amount of from 1 to 15 wt %, more preferably from 2 to 10 wt % and most preferably from 4 to 7 wt % of the demulsifier.

The $C_6$ to $C_{18}$ alcohol ethoxylate is preferably produced from at least one alcohol and more preferably at least one mono-ol. The ethoxylates preferably have from 2 to 8 ethoxy-groups. Preferred ethoxylates include nonylphenol ethoxylate and $C_9$-$C_{12}$ ethoxylates. Suitable ethoxylates are commercially available. Suitable ethoxylates include Berol 260 and Ethylan 1005, which are narrow range ethoxylated alcohols commercially available from AkzoNobel.

Nonylphenol ethoxylates have a range of HLB values depending on the number of ethylene oxide groups present. Preferred nonylphenol ethoxylate have from 4 to 8 ethylene oxide groups, which have an HLB of approximately from 9 to 12. A particularly preferred nonylphenol ethoxylate has 6 ethylene oxide groups and a HLB of approximately 11.

Berol 260 has a HLB value of 10.5 and is a narrow range $C_9$11 alcohol with 4 ethylene oxide groups. Ethylan 1005 has a HLB value of 11.6 and is a narrow range $C_{10}$ alcohol with 3.5 ethylene oxide groups.

It is preferred that the alcohol ethoxylate has a HLB value in the range of 9 to 12 and preferably from 10 to 12.

The alcohol ethoxylate is preferably present in an amount of from 5 to 30 wt % of the demulsifier. It is further preferred that the alcohol ethoxylate is present in an amount of from 5 to 20 wt % and more preferably from 8 to 12 wt %.

The sorbitan ester is the reaction product of sorbitan and one or more carboxylic acids. Preferably, the carboxylic acids have from 8 to 22 carbon atoms. Preferably the carboxylic acids have from 8 to 22 carbon atoms, which is the length of carbon chains found in naturally occurring fatty acids in triglycerides. Particularly preferred are carboxylic acids having from 16 to 22 carbon atoms and even more preferably having 18 carbon atoms. The fatty acids can be both linear and branched.

Both saturated and unsaturated fatty acids are suitable. However, unsaturated fatty acids are preferred.

Some sorbitan esters which are suitable for use in the present invention include:

| Ester | HLB |
|---|---|
| Sorbitan tristearate | 2.1 |
| Sorbitan monooleate | 4.3 |
| Sorbitan isostearate | 4.7 |
| Sorbitan trioleate | 1.8 |
| Sorbitan sesquioleate | 3.7 |

Suitable sorbitan esters have an HLB of less than 6.0. Preferred sorbitan esters are those having an HLB of from 3 to 5. Particularly preferred is sorbitan monooleate.

A particular preferred demulsifier may comprise:

a. 50-90 wt % of at least one $C_8$ to $C_{18}$ fatty acid diethanolamide;

b. 2-10 wt % of at least one $C_{12}$ to $C_{24}$ fatty acid;

c. 5-20 wt % of at least one $C_6$ to $C_{18}$ alcohol ethoxylate; and optionally d. 10-40 wt % of at least one sorbitan ester.

Preferred components a to d are as defined above.

In a preferred embodiment, the demulsifier comprises or consists essentially of 80-90 wt % of component a, 4-8 wt % of component b and 5-15 wt % of component c.

In a further preferred embodiment, the demulsifier comprises or consists essentially of 55-65 wt % of component a, 4-8 wt % of component b, 5-15 wt % of component c and 20 to 30 wt % of component d.

The demulsifiers of the present invention advantageously improve the recovery of oils from an oil-in-water emulsion. These demulsifiers, which can be produced using naturally occurring materials, are therefore beneficial as they are environmentally beneficial as they do not typically contain components which are harmful to produce.

The demulsifier can be added to the emulsion together with at least one $C_{12}$ to $C_{24}$ fatty acid or an alkylene glycol monoalkyl ether. Preferably 1 part demulsifier is added with 5-10 parts fatty acid or alkylene glycol monoalkyl ether.

The at least one $C_{12}$ to $C_{24}$ fatty acid is preferably saturated or monounsaturated, with monounsaturated fatty acids being further preferred. The fatty acid is preferably a $C_{14-20}$ monounsaturated fatty acid. The at least one $C_{12}$ to $C_{24}$ fatty acid used to dilute the demulsifier may be the same or different to the at least one $C_{12}$ to $C_{24}$ fatty acid present in the demulsifier. A particularly suitable fatty acid is oleic acid.

The combined demulsifier and fatty acid composition added to the emulsion may comprise:

a. 10-20 wt % of at least one $C_8$ to $C_{18}$ fatty acid diethanolamide;

b. 75-85 wt % of at least one $C_{12}$ to $C_{24}$ fatty acid;

c. 0.5-5% of at least one $C_6$ to $C_{18}$ alcohol ethoxylate; and optionally d. 2-8 wt % of at least one sorbitan ester.

Preferably, the combined composition may consist essentially of components (a), (b), (c) and optionally (d). Preferred components (a) to (d) are as defined above.

Alternatively the combined demulsifier and alkylene glycol monoalkyl ether composition added to the emulsion may comprise:

a. 10-18 wt % of at least one $C_8$ to $C_{18}$ fatty acid diethanolamide;

b. 0.4-2.0 wt % of at least one $C_{12}$ to $C_{24}$ fatty acid;

c. 0.5-5 wt % of at least one $C_6$ to $C_{18}$ alcohol ethoxylate;

d. 67.0-89.1 wt % of at least one alkylene glycol monoalkyl ether and optionally e. 2-8 wt % of at least one sorbitan ester.

Preferably, the diluted demulsifier consists essentially of components (a), (b), (c), (d) and optionally (e). Preferred components (a) to (c) and (e) are as defined above.

The alkylene glycol monoalkyl ether is preferably an ethylene glycol monoalkyl ether and more preferably an ethylene glycol monoalkyl ether in which the alkyl group has from 1 to 6 carbon atoms. More preferably, the ether is preferably 2-butoxyethanol (butyl oxitol).

The alkylene glycol monoalkyl ether is preferably used in an amount of 67.0-89.1% by weight and more preferably from 68.5-83.5% by weight, even more preferably 70-80%.

Preferably, the invention provides a process for recovering oil from an oil-in-water emulsion comprising:

(i) adding 0.01-4.0 wt % demulsifier to an oil-in-water emulsion wherein the demulsifier comprises:

a. at least one $C_8$ to $C_{18}$ fatty acid diethanolamide;

b. at least one $C_{12}$ to $C_{24}$ fatty acid; and c. at least one $C_6$ to $C_{18}$ alcohol ethoxylate; and optionally d. at least one sorbitan ester; and (ii) dispersing the demulsifier in the oil using ultrasonication at 2-50 Ws/g.

In another aspect the invention provides a process for recovering oil from a waste oil-in-water emulsion comprising:

(i) adding at least 0.01 wt % demulsifier to said waste oil-in-water emulsion (ii) dispersing the demulsifier in the oil using ultrasonication at between 2-50 Ws/g;

(iii) allowing the oil and aqueous phases to separate;

wherein the demulsifier comprises a $C_{12}$-$C_{24}$ carboxylic or sulphonic acid or a $C_8$ to $C_{18}$ fatty acid diethanolamide.

Demulsifiers suitable for use in this aspect of the invention comprise a $C_{12}$-$C_{24}$ carboxylic or sulphonic acid, or a mixture thereof. The $C_{12}$-$C_{24}$ carboxylic or sulphonic acid may be aliphatic or aromatic, saturated or unsaturated. Suitable carboxylic acids include fatty acids, which may be saturated or unsaturated, as described above.

As used herein, a sulphonic acid has the formula R—S(=O)$_2$—OH, where R is a $C_{12}$-$C_{24}$ group. R may be an alkyl or aryl group, or combination thereof e.g. an alkylaryl group.

An "alkyl" is branched, straight-chain, or cyclic saturated hydrocarbon group of 1 to 24 carbon atoms. Preferably the alkyl contains 6-20 carbon atoms, more preferably 12-18 carbons atoms.

An "aryl" group is a 5-18 member aromatic monocyclic or bicyclic ring structure. Example of aryls include phenyl, biphenyl, and napthyl.

Suitable sulphonic acids include dodecylbenzene sulphonic Acid, and decylbenzene sulphonic Acid. Preferably the demulsifier comprises dodecylbenzene sulphonic acid.

The demulsifier may comprise or consist essentially of oleic acid or sulphonic acid (preferably dodecylbenzene sulphonic acid). In this aspect, the demulsifier comprises at least 80 wt % oleic acid or sulphonic acid, preferably at least 85 wt %, 90 wt %, 95 wt %, 97 wt %, or 99 wt %.

Preferably, the demulsifier is as described for use in the process of the first aspect.

Preferably the demulsifier comprises oleic acid.

Preferably the demulsifier comprises:

a. at least one C8 to C18 fatty acid diethanolamide;

b. at least one C12 to C24 fatty acid; and c. at least one C6 to C18 alcohol ethoxylate d. optionally at least one sorbitan ester. Preferably, the demulsifier consists essentially of components (a), (b), (c) and optionally (d).

Preferably the fatty acid diethanolamide is derived from coconut oil diethanolamide.

Preferably the alcohol ethoxylate is nonylphenol ethoxylate

The addition of the demulsifier causes the emulsion to break, allowing the aqueous phase and the oil phase to separate. The efficiency of the separation process depends on the amount of demulsifier present, the degree of mixing of the emulsion and demulsifier, and the temperature of the emulsion.

Ultrasonic power is an efficient and energy-efficient means to apply high shear and intense stress to liquids, powder/liquid mixtures and slurries. This makes it a strong alternative to high shear mixers, high pressure homogenisers and other forms of macro mixing. Ultrasonication is used to agitate the mixture in order to make a fine dispersion.

One benefit of agitating the emulsion using ultrasonication is the rate at which the emulsions can be broken, and the oil and water separated. The emulsions can be broken in minutes rather than hours. The amount of water recovered from the emulsion is also increased.

Ultrasound applications are described in terms of Ws/g. That is the power (W) applied, every second (s) per mass gram (g) or volume (mL) of material being sonicated. Every process has a specific energy (Ws) that is optimal per mL and this is different for every process. If too little specific energy is used, the process is incomplete. However, if the specific energy used is too high, this results in a waste of time and energy, and potentially damage to the equipment.

The optimal Ws/g has been determined to be between 2-50 Ws/g, preferably 5-30 Ws/g depending on the ratio of water and oil that is being separated. A higher specific energy can be used, for example up to 250 Ws/g, but as discussed above this results in a waste of time and energy, as separation can be achieved in the same time using a lower energy level. Preferably the Ws/g is in the range 7-20 Ws/g, more preferably in the range 8-17 Ws/g, even more preferably in the range 10-15 Ws/g.

Alternatively, the specific energy required can be measured as the power (W) applied, every second (s) per volume (ml). In practice this may be simpler to calculate as the specific gravity of the oil-in-water emulsion can vary. The specific gravity of oil-in-water emulsions separated by the process of the invention is typically 0.8-0.98 g/mL. Therefore, 1 Ws/g is equivalent to 0.8-0.98 Ws/g. HFO has a specific gravity of about 1.0.

The optimal Ws/ml has been determined to be between 2-62.5 Ws/ml, preferably 5.1-37.5 Ws/ml depending on the ratio of water and oil that is being separated. A higher specific energy can be used, for example up to 255 Ws/ml, but as discussed above this results in a waste of time and energy, as separation can be achieved in the same time using a lower energy level. Preferably the Ws/ml is in the range 7.1-25 Ws/ml, more preferably in the range 8.1-21.25 Ws/ml, even more preferably in the range 10.2-18.75 Ws/ml.

An increase in total power often means a reduction in the time required to sonicate a set volume. Conversely, an increase in volume of material, i.e. to scale up, means an increase in the either the total time, or applied power is required to maintain the optimal Ws/g.

The specific energy required to break the emulsion may also depend on the concentration of the demulsifier present. If a low amount of demulsifier is used, then a higher specific energy is required. If more demulsifier is used, then the specific energy required is less. Preferably the demulsifier is present in an amount of at least 0.2 wt % based on the amount of oil-in-water emulsion, and the specific energy is at least 10 Ws/g or 10.2 Ws/ml. More preferably, the demulsifier is present in an amount of at least 0.25 wt % based on the amount of oil-in-water emulsion, and the specific energy is at least 7.5 Ws/g or 7.65 Ws/ml; or the demulsifier is present in an amount of at least 0.5 wt % based on the amount of oil-in-water emulsion, and the specific energy is at least 5.0 Ws/g or 5.10 Ws/ml.

The demulsification process is typically carried out at 25-80° C., preferably between 55-70° C., more preferably about 65° C.

The demulsification process is typically carried out at pH 4 to 7, preferably pH 5.5.

Once the emulsion has been broken, the water and oil can be separated by conventional techniques, including, for example, centrifugation or gravity separation. For example, the emulsion can be allowed to settle through gravity and the water/aqueous layer can be drained off. The drained water can undergo additional treatment if required to further reduce the oil content such as pH adjustment, filtration, and membrane separation. Ideally the amount of oil in the water is reduced to below 15 ppm so it is not considered to be "contaminated water" and can be safely and legally discharged overboard or into the sea.

Typically, the broken emulsion is allowed to separate through gravity. After mixing the demulsifier and the oil-in-water emulsion, the separation begins immediately. The time required to allow complete separation of the water and oil phases may vary depending on the concentration of demulsifier used, the specific energy applied, and the temperature. Preferably the separation is complete after 24 hours or less. Preferably the phases can be separated after 24 hours. Preferably the phases can be separated after 12 hours, 6 hours, 5 hours, 4 hours, two hours or 1 hour. However, in some circumstances a longer separation time of more than 24 hours may be used, such as where large storage facilities exist.

The separated oil preferably has a water content less than 10% v/v, more preferably less than 5% v/v, less than 2.5% v/v, most preferably less than 1% v/v.

In another aspect the invention provides an apparatus for removing water from an oil-in-water emulsion comprising (a) a separation means comprising an inlet;
(b) optionally means for introducing a demulsifier; and
(c) an ultrasonic device in fluid communication with the separation means.

The separation means is a device for separating the aqueous and oil phases of the oil-in-water emulsion once the emulsion has been broken though addition of the demulsifier. The separating means may be a centrifuge or a settling tank.

The demulsifier is added to the oil-in-water emulsion, and then the mixture passes through the ultrasonic device to ensure thorough mixing. After ultrasonication, the mixture passes to the separation means to bring about separation of the aqueous and oil phases.

In a preferred embodiment the apparatus comprises (a) a settling tank comprising an inlet and a first outlet located at the base of the settling tank;
(b) optionally means for introducing a demulsifier
(c) an ultrasonic device in fluid communication with the settling tank;

wherein the ultrasonic device is in a closed circuit with the settling tank.

The demulsifier is preferably a demulsifier as described above.

The inlet is controlled by a valve, and allows the oil-in-water emulsion to enter the tank. It is preferably located close to the top of the tank.

The first outlet is located at the base of the tank, and allows the contents of the tank to be drained. The first outlet may be located on the base of the separation tank or it may exit through the side wall of the tank near to the base. Once the emulsion has been broken, and the oil and water separated, the separate phases can be drained off. Both the water and the oil phase may be drained through the same outlet. Alternatively, a second outlet may be present, and the water phase removed via one outlet, and the oil phase removed via the other outlet. Each outlet is controlled by a valve.

The settling tank is in fluid communication with an ultrasonic device, which is in a closed circuit with the settling device. The waste oil-in-water emulsion, together with the demulsifier, is passed through the ultrasonic device, mixing the demulsifier and emulsion. Once the emulsion/demulsifier have been subjected to ultrasonication, the mixture is returned to the settling tank. The contents of the settling tank may be pumped to the ultrasonic device, and returned to the settling tank. The contents of the settling tank may be passed through the ultrasonic device one or more times. This is to ensure sufficient mixing of the demulsifier and emulsion, so the phases begin to separate within 1 hour of being allowed to settle. The number of passes through the ultrasonic device will depend on several factors including flow rate, and power of the ultrasonic device. The contents of the setting tank need to be exposed to sufficient specific energy to bring about efficient separation. As described above, this is typically 2-50 Ws/g or 2-62.5 Ws/ml. Preferably the contents of the settling tank pass through the ultrasonic device between 1-5 times, more preferably 1-3 times before being allowed to settle.

The demulsifier may be added to the oil-in-water emulsion prior to entry into the settling tank. Alternatively, the demulsifier may be added to the oil-in-water emulsion in the settling tank. The settling tank may comprise a further inlet, controlled by a valve, for the addition of the demulsifier, or the demulsifier may be added through the same inlet as the oil-in-water emulsion. In a further alternative, the demulsifier may be added to the oil-in-water emulsion as it passes from the settling tank to the ultrasonic device. The connection between the settling tank and the ultrasonic device may comprise an inlet, controlled by a valve, so that the demulsifier can be fed into the oil-in-water emulsion. Preferably the demulsifier is added as or shortly before the emulsion enters the ultrasonic device or, if present, the pump used to transfer the emulsion to the ultrasonic device.

Suitable ultrasonic devices include industrial ultrasonic transducers such as those designed to assist in the transesterification reaction in the production of biodiesel, for example those produced by Hieslscher Ultrasound GmbH. These include both sonotrodes and cascatrodes. One or more ultrasonic devices can be used. Multiple devices arranged in series to allow for increased throughput. Alternatively a single larger device can be used to meet the required processing of the same volume within the same time.

In an alternative aspect, the invention provides an apparatus for removing water from a waste oil-in-water emulsion comprising (a) a holding tank comprising an inlet, an outlet and optionally a means for introducing a demulsifier;
(b) an ultrasonic device in fluid communication with the holding tank
(c) a separation means.

The separation means is a device for separating the aqueous and oil phases of the oil-in-water emulsion once the emulsion has been broken though addition of the demulsifier. The separating means may be a centrifuge or a settling tank In a preferred embodiment the apparatus comprises (a) a holding tank comprising an inlet, an outlet and optionally a means for introducing an demulsifier;
(b) an ultrasonic device in fluid communication with the holding tank
(c) a settling tank in fluid communication with the ultrasonic device, the settling tank comprising an inlet and an outlet located at the base of the settling tank.

The emulsion to be broken, for example the ships slops can be stored in the holding tank(1). If the emulsion is a water-in-oil emulsion it can be converted to an oil-in-water emulsion by adding at least the same volume as the emulsion of water to the tank. The emulsion is transferred to the flowcell of the ultrasonic device (4). The flow rate can be controlled by a pump (2) and/or a valve(3).

A demulsifier is added to the emulsion. The demulsifier can be added to the emulsion in the holding tank (1). The holding tank may comprise a further inlet controlled by a valve to allow the addition of the demulsifier. The demulsifier can also be added through the same inlet as the emulsion. In a further alternative, the demulsifier may be added to the oil-in-water emulsion as it passes from the holding tank to the ultrasonic device (4). The connection between the holding tank and the ultrasonic device may comprise an inlet, controlled by a valve, so that the demulsifier can be fed into the oil-in-water emulsion. Preferably the demulsifier is added as or shortly before the emulsion enters the ultrasonic device or, if present, the pump (2) used to transfer the emulsion to the ultrasonic device.

The oil-in-water emulsion, together with the demulsifier, is passed through the ultrasonic device, mixing the demulsifier and emulsion. Once the emulsion/demulsifier have been subjected to ultrasonication, in a single pass set-up, the mixture can be transferred to the settling tank (7), and the water and oil phases allowed to separate out. Flow to the settling tank can be control by a valve (5)

The mixed emulsion/demulsifier can be subjected to one or more further rounds of ultrasonication prior to being allowed to settle in the settling tank. The mixed emulsion/demulsifier may be optionally recirculated and transferred back to the holding tank (1) or directly to the flowcell (4) of the ultrasonication device before being subjected to a further round(s) of ultrasonication. Flow to the holding tank (1) can be control by a valve (6). The optional pathways are indicated with a dashed line in FIG. 3.

Once the emulsion/demulsifier has been sufficiently mixed by ultrasonication, the mixture is transferred to the settling tank and allowed to settle.

Alternatively, the mixed emulsion/demulsifier may be transferred to the settling tank, and then returned to the ultrasonication device for further round(s) of ultrasonication before being allowed to settle.

The preferred features of the settling tank are as described above.

The preferred features of the demulsifier are as described above.

In a further aspect of the present invention, there is provided the use of a demulsifier to recover oil from a waste oil-in-water emulsion, said demulsifier comprising:

a. at least one $C_8$ to $C_{18}$ fatty acid diethanolamide;
b. at least one $C_{12}$ to $C_{24}$ fatty acid; and
a. at least one $C_6$ to $C_{18}$ alcohol ethoxylate and optionally c. at least one sorbitan ester, wherein the demulsifier is used in an amount of at least 0.01 wt % based on the amount of emulsion.

The preferred features of the demulsifier are as described above. In a further aspect of the present invention, there is provided a composition comprising:

an oil-in-water emulsion, wherein the emulsion comprises at least 50 wt % water and at least 0.01 wt % demulsifier said demulsifier comprising:

a. at least one $C_8$ to $C_{18}$ fatty acid diethanolamide;

b. at least one $C_{12}$ to $C_{24}$ fatty acid;

c. at least one $C_6$ to $C_{18}$ alcohol ethoxylate; and optionally d. at least one sorbitan ester.

Preferred components a to d are as defined above.

In an alternative aspect, there is provided a composition comprising:

A waste oil-in-water emulsion, wherein the emulsion comprises at least 50 wt % water and at least 0.01 wt % demulsifier said demulsifier comprising or consisting essentially of oleic acid or a sulphonic acid.

The invention will be further described with reference to the following Figures:

FIG. 1 shows the separation of the emulsion into an aqueous (water) layer and an oil layer following addition of a demulsifier and treatment with ultrasonication. The demulsifier is (a) oleic acid; (b) dodecylbenzene sulphonic acid and (c) demulsifier composition of Example 1.

Figure 2:
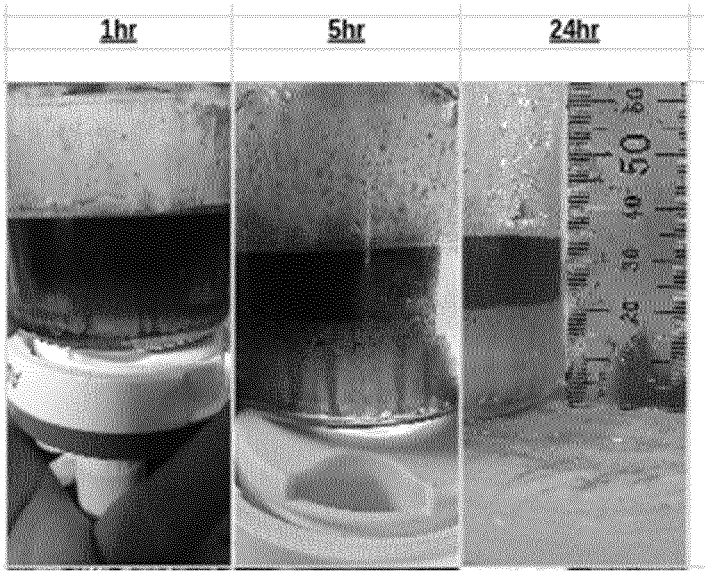
Figure 2:
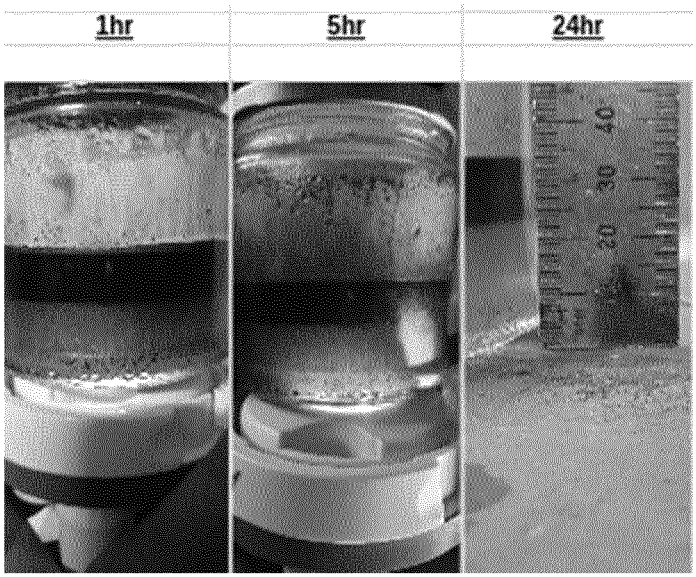
Figure 2:
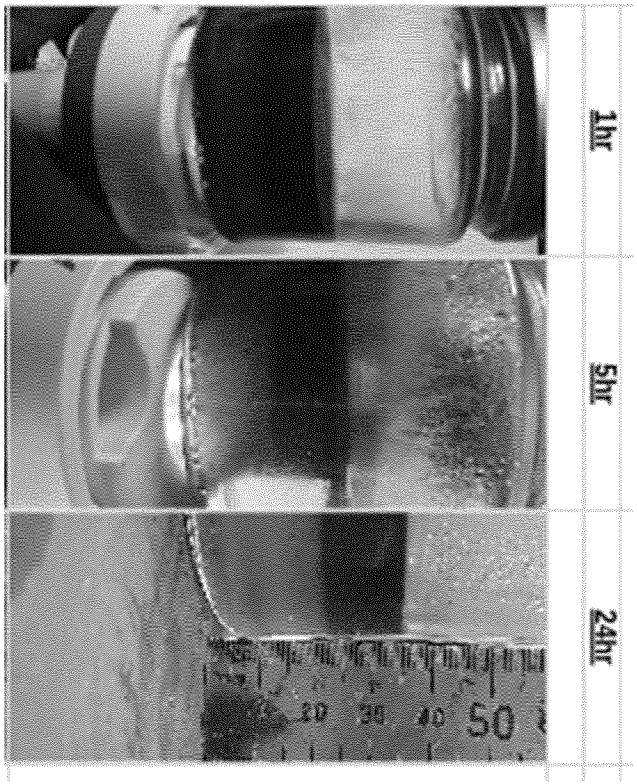

FIG. 2 shows the separation of the emulsion into an aqueous (water) layer and an oil layer following addition of a demulsifier and treatment with ultrasonication. The demulsifier is (a) demulsifier composition of Example 1; (b) combination of 1 part by weight demulsifier composition of Example 1 with 4 parts oleic acid and (c) combination of 1 part by weight demulsifier composition of Example 1 with 4 parts butyl oxitol.

Figure 3:
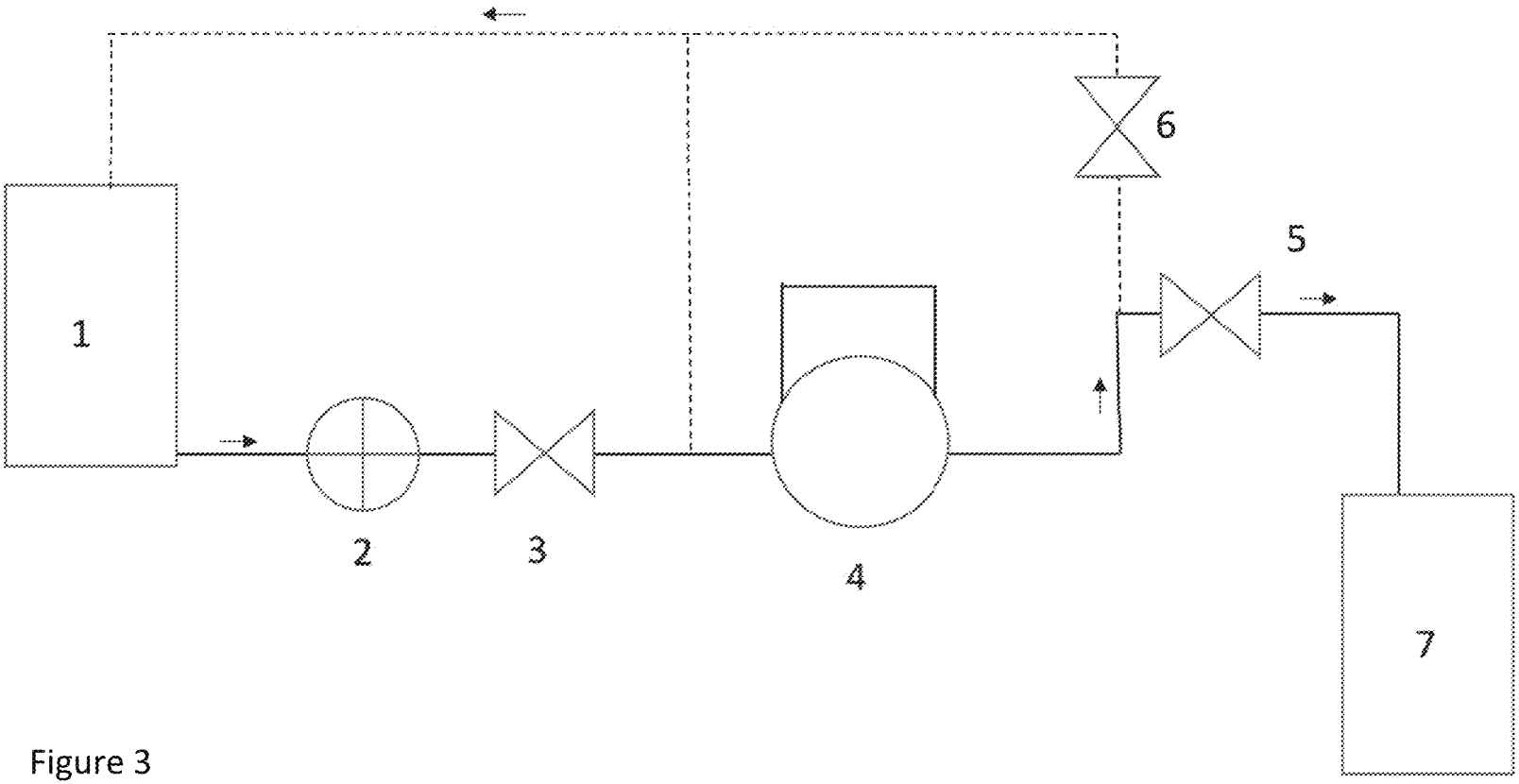

FIG. 3 shows the processing apparatus.

The invention will be further described with reference to the following Examples.

EXAMPLES

A demulsifier composition was prepared containing

85% w/w Coconut fatty acid diethanolamide (SABO®)

5% w/w Oleic acid (NuVest)

10% w/w Nonylphenol polyethoxylate

Emulsions

Ships slops were obtained from a waste oil disposal company. The samples were taken from a tanker used to collect the ships slops from vessels.

Testing

Testing was carried out using a modified version of the bottle test. Demulsifiers were added to a series of tubes each containing the same volume of emulsion to be broken. The demulsifier was added to the sample and subjected to ultrasonication using a 22 mm sonotrode (UP400St Hielscher Ultrasound Technology 400 W, 24 kHz) at maximum amplitude, 150 W, at 65° C.

The separation of the phases was monitored by the position of the water/emulsion interface, and the volume of separated water noted.

Example 1

2% w/w demulsifier composition was added to 500 ml ships slops (500 g) and treated with ultrasound for 100 s. This provides approximately 30 Ws/g. The contents of the tube were then allowed to settle.

The results are shown in Table 1.

TABLE 1

| Fuel | Quantity ml | Demulsifier % | Temp ° C. | Ultrasound Amplitude | Ultrasound Power (W) | Ultrasound Time (s) | Water/Total volume mm |
|---|---|---|---|---|---|---|---|
| HFO | 500 | 2 | 65 | Max | 150 | 100 | 80/150 |

Results

After settling, the aqueous phase measured 80 mm of total height of 150 mm. The original sample therefore contained about 54% water.

The water content of the oil was determined and found to be 0%.

Example 2

Compositions were tested to measure the amount of demulsifier required to break the emulsion.

100 ml of ships slops was weighed and then mixed with the demulsifier composition in the amounts set out in Table 2. The mass was 100 g. The emulsion/demulsifier mixtures were subjected to ultrasonication for 150 s using a 22 mm sonotrode at maximum amplitude, 150 W, at 65° C. This provides approximately 225 Ws/g The separation of the phases was monitored by the position of the water/emulsion interface, and the volume of separated water noted.

The results are shown in Table 2.

TABLE 2

| Fuel | Quantity ml | Demulsifier % | Temp ° C. | Ultrasound Amplitude | Ultrasound Power (W) | Ultrasound Time (s) | Water/Total volume mm |
|---|---|---|---|---|---|---|---|
| HFO | 100 | 2 | 65 | Max | 150 | 150 | 18/34 |
| HFO | 100 | 1 | 65 | Max | 150 | 150 | 18/34 |
| HFO | 100 | 0.5 | 65 | Max | 150 | 150 | 18/34 |
| HFO | 100 | 0.25 | 65 | Max | 150 | 150 | 18/34 |

After settling, the aqueous phase measured 18 mm of total height of 34 mm in all samples, The water content of the oil was determined and found to be 0%. Thus a measurement of 18/34 mm water represents complete separation of the emulsion. The results indicate that a level of 0.25% w/w demulsifier composition is sufficient to destabilise, and completely separate the emulsion.

Example 3

The amount of ultrasonication required to break the emulsion was investigated.

0.25% w/w demulsifier was added to 100 ml ships slops (100 g) and treated with ultrasound using a 22 mm sonotrode at maximum amplitude, 150 W, at 65° C. The length of the ultrasound treatment was varied as indicated in Table 3. The contents of the tube were then allowed to settle for 24 hours. The separation of the phases was monitored by the position of the water/emulsion interface, and the volume of separated water noted (mm water/total height mm).

The results are shown in Table 3.

TABLE 3

| Fuel | Quantity ml | Demulsifier % | Temp ° C. | Ultrasound Amplitude | Ultrasound Power (W) | Ultrasound Time (s) | Ws/g | Water/Total volume mm |
|---|---|---|---|---|---|---|---|---|
| HFO | 100 | 0.25 | 65 | Max | 150 | 5 | 7.5 | 18/34 |
| HFO | 100 | 0.25 | 65 | Max | 150 | 4 | 6.0 | 16/34 |
| HFO | 100 | 0.25 | 65 | Max | 150 | 2 | 3.0 | 12/34 |

After settling, the aqueous phase measurements varied for times less than 5 s. The emulsion/demulsifier mixture needed to be treated with ultrasound for at least 5 seconds using the exemplified power settings, giving an exposure of 7.5 Ws/g or more, in order to provide consistent complete separation within 24 hours. Complete separation of the samples was seen after a longer settling time.

Example 4

100 ml of ships slops was weighed and mixed with the demulsifier composition in the amounts set out in Table 4. The mass of the untreated ships slops was 100 g. The emulsion/demulsifier mixtures were subjected to ultrasonication using a 22 mm sonotrode at maximum amplitude, 150 W, at the temperatures and for the length of time shown in Table 4.

The separation of the phases was monitored by the position of the water/emulsion interface, and the amount of separated water noted (mm water/total height mm) after 24 hours.

The results are shown in Table 4.

TABLE 4

| Fuel | Quantity ml | Demulsifier % w/w | Temp ° C. | Ultrasound Amplitude | Ultrasound Power (W) | Ultrasound Time (s) | Ws/g | Water/Total volume mm |
|---|---|---|---|---|---|---|---|---|
| HFO | 100 | 0 | 65 | Max | 150 | 0 | 0.0 | 0/34 |
| HFO | 100 | 0.05 | 65 | Max | 150 | 5 | 7.5 | 23/34 |
| HFO | 100 | 0.15 | 65 | Max | 150 | 5 | 7.5 | 22/34 |
| HFO | 100 | 0.25 | 55 | Max | 150 | 2 | 3.0 | 12/34 |
| HFO | 100 | 0.25 | 50 | Max | 150 | 0 | 0.0 | 16/34 |

The sample which was not treated with demulsifier or ultrasound had a homogeneous black appearance, with no separation. There was a muddy appearance to the aqueous phase in the remaining samples. The muddy appearance, and an aqueous phase volume greater than 18 mm indicates that there is contamination and oil present. Therefore the separation is not complete. However, complete separation did occur once the samples had been allowed to settle for a longer period of time.

The results show that reducing the amount of demulsifier present or the temperature reduces the efficiency of the separation.

Example 5

100 ml ships slops was weighed and mixed with 0.25% v/v the demulsifier composition, oleic acid or dodecylbenzene sulphonic Acid. The mass of the untreated ships slops was 100 g. The emulsion/demulsifier mixtures were subjected to ultrasonication for 5 s using a 22 mm sonotrode at maximum amplitude, 150 W, at 65° C. This provides approximately 7.5 Ws/g. the samples were then allowed to settle.

As shown in FIG. 1, after 24 hours all of the samples had separated to provide aqueous and oil layers. The height of the aqueous layer achieved was identical, indicating that all three demulsifiers were equally as effective.

It is expected that this process will enable higher levels of water to be recovered whilst requiring a shorter amount of time for separation. The skilled person is capable of refining the specific amounts of the composition and the water.

Example 6

One part of the demulsifier composition was mixed with four parts by weight oleic acid or butyl oxitol.

100 ml ships slops was weighed and mixed with 0.25% v/v the demulsifier composition, or the demulsifier composition additionally containing the oleic acid or butyl oxitol as indicated in Table 5. The mass of the untreated ships slops was 100 g. The emulsion/demulsifier mixtures were subjected to ultrasonication for 5 s using a 22 mm sonotrode at maximum amplitude, 150 W, at 65° C. This provides approximately 7.5 Ws/g. The samples were then allowed to settle.

As shown in FIG. 2, after 1 hour the samples mixed with the demulsifier composition or the demulsifier plus oleic acid had formed clearly defined layers. After 24 hours all of the samples had separated to provide aqueous and oil layers. The height of the aqueous layer achieved was identical, indicating that all three demulsifiers were equally as effective.

| Fuel | Quantity ml | Demulsifier 0.25% | Temp ° C. | Ultrasound Amplitude | Ultrasound Power (W) | Ultrasound Time (s) | Ws/g | Water/Total volume mm |
|---|---|---|---|---|---|---|---|---|
| HFO | 100 | Demulsifier | 65 | Max | 120-150 | 5 | 7.5 | 23/34 |
| HFO | 100 | 1 part Demulsifier: 4 parts oleic acid | 65 | Max | 120-150 | 5 | 7.5 | 23/34 |
| HFO | 100 | 1 part Demulsifier: 4 parts butyl oxitol | 65 | Max | 120-150 | 5 | 7.5 | 23/34 |

Example 7 Pilot Plant

A pilot plant capable of treating larger volumes of oil-in-water emulsions was set up.

A collection tank (35-50 L capacity) was connected to a flow cell of an ultrasonic transducer (UIP1000hdT (1000 W, 20 kHz) from Hielscher Ultrasonics). The outlet of the flow cell was either connected in a return loop to the collection tank, or connected to a separate settling tank. One or more valves were placed within the connecting pipes to control the flow of the fluid. A positive displacement pump was used to move fluid from the collection tank to the flow cell. Typically the ultrasonic transducer can process around 0.5-4.0 L/min depending on the amplitude and power required to treat the emulsion.

Initially, the collection tank was filled with a batch of ships slops. 0.25% v/v the demulsifier composition was added to approximately 5 L ships slops in the collection tank. The emulsion/demulsifier mixture was then pumped to the flowcell of the ultrasonic transducer and sonicated at 7.5 Ws/g before being transferred to the settling tank. After 24 hours the ships slops had separated into water and oil layers. The results were similar to those produced in the earlier examples.

In this specification, unless expressly otherwise indicated, the word 'or' is used in the sense of an operator that returns a true value when either or both of the stated conditions is met, as opposed to the operator 'exclusive or' which requires that only one of the conditions is met. The word 'comprising' is used in the sense of 'including' rather than in to mean 'consisting of'. All prior teachings acknowledged above are hereby incorporated by reference. No acknowledgement of any prior published document herein should be taken to be an admission or representation that the teaching thereof was common general knowledge in Australia or elsewhere at the date hereof.

The invention claimed is:

1. A process for recovering oil from an oil-in-water emulsion comprising:

(i) adding at least 0.01 wt % demulsifier to said oil-in-water emulsion (ii) dispersing the demulsifier in the oil using ultrasonication at between 2-50 Ws/g;

(iii) allowing the oil and aqueous phases to separate;

wherein the demulsifier comprises a. at least one $C_8$ to $C_{18}$ fatty acid diethanolamide;

b. at least one $C_{12}$ to $C_{24}$ fatty acid;

c. at least one $C_6$ to $C_{18}$ alcohol ethoxylate and optionally d. at least one sorbitan ester.

2. The process of claim 1 wherein said oil is a fuel oil.

3. The process of claim 1 wherein 0.05-4.0 wt % demulsifier is added to said oil-in-water emulsion.

4. The process of claim 1 wherein the demulsifier comprises oleic acid.

5. The process of claim 1 wherein the demulsifier comprises:

a. 50-90 wt % of at least one $C_8$ to $C_{18}$ fatty acid diethanolamide;

b. 2-10 wt % of at least one $C_{12}$ to $C_{24}$ fatty acid;

c. 5-20 wt % of at least one $C_6$ to $C_{18}$ alcohol ethoxylate; and optionally d. 10-40 wt % of at least one sorbitan ester.

6. The process of claim 1 wherein the ultrasonication is carried out at 2-15 Ws/g.

7. The process of claim 1, comprising the steps of:

(i) converting a water-in-oil emulsion to an oil-in-water emulsion by adding a volume of water greater than or equal to the volume of the water-in-oil emulsion;

(ii) adding at least 0.01 wt % demulsifier to said oil-in-water emulsion;

(iii) dispersing the demulsifier in the oil using ultrasonication at between 2-50 Ws/g;

(iv) allowing the oil and aqueous phases to separate.

8. The process of claim 1, wherein the oil-in-water emulsion further comprises an additional $C_{12}$ to $C_{24}$ fatty acid and/or alkylene glycol monoalkyl ether.

9. The process of claim 8, wherein the ratio of demulsifier to the additional $C_{12}$ to $C_{24}$ fatty acid and/or alkylene glycol monoalkyl ether added is 1 part demulsifier: 5-10 parts additional fatty acid or alkylene glycol monoalkyl ether.

10. The process of claim 8 wherein the total amount of demulsifier and additional $C_{12}$ to $C_{24}$ fatty acid and/or alkylene glycol monoalkyl ether present is 0.25-20.0 wt %.

* * * * *